United States Patent [19]

Watanabe et al.

[11] Patent Number: 4,883,735

[45] Date of Patent: Nov. 28, 1989

[54] NEGATIVELY CHARGEABLE TONER FOR USE IN DRY ELECTROPHOTOGRAPHY

[75] Inventors: Masao Watanabe; Hiroshi Nagase, both of Tokyo, Japan

[73] Assignee: Fujikura Kasei Co., Ltd., Tokyo, Japan

[21] Appl. No.: 148,349

[22] Filed: Jan. 25, 1988

[30] Foreign Application Priority Data

Jan. 28, 1987 [JP] Japan ..... 62-16267

[51] Int. Cl.[4] ..... G03G 9/00; G03G 13/20

[52] U.S. Cl. ..... 430/109; 430/110

[58] Field of Search ..... 430/110, 109

[56] References Cited

U.S. PATENT DOCUMENTS 4,415,646 11/1983 Gruber et al. ..... 430/110

4,656,111 4/1987 Wakamiya et al. ..... 430/110

*Primary Examiner*—John L. Goodrow

*Attorney, Agent, or Firm*—Wenderoth, Lind & Ponack

[57] ABSTRACT

A negatively chargeable toner for use in dry electrophotography, said toner comprising (A) a resinous binder composed of at least one resin selected from copolymers of styrene and/or alpha-methylstyrene with alkyl (meth)acrylates, (B) 2 to 10 parts by weight, per 100 parts by weight of the resinous binder, of a copolymer containing a sulfonic acid group, said copolymer having a weight average molecular weight of from 2,000 to 15,000 and composed of 80 to 98% by weight of recurring units represented by the formula

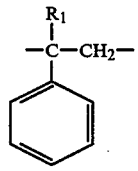

(I)

wherein $R_1$ represents a hydrogen atom or a methyl group, and 20 to 2% by weight of recurring units represented by the formula

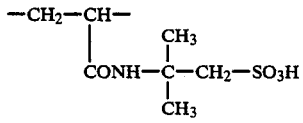

(II)

and (C) a coloring agent.

11 Claims, No Drawings

NEGATIVELY CHARGEABLE TONER FOR USE IN DRY ELECTROPHOTOGRAPHY

This invention relates to a toner for use in dry electrophotography, and more specifically, to a negatively chargeable toner for use in dry electrophotography to develop a latent electrostatic image to a visible image.

Toners used in developing a latent electro-static image to a visible image in dry electrophotography are generally produced by pre-mixing a thermoplastic resin, a coloring agent and a charge controlling agent and optionally a magnetic powder and other additives, melt-kneading the mixture, pulverizing and classifying the mixture to form colored particles (to be referred to as "toner particles") having a desired particle diameter. Those toner particles which do not contain a magnetic powder are called a two-component toner, and when they are mixed and agitated with a separately prepared magnetic powder, a certain amount of a positive or negative charge is built up on the surface of the toner particles, and the charged particles are used in developing a latent electrostatic image. Those toner particles which have a magnetic powder dispersed therein are called a one-component toner, and a positive or negative charge is built up on the surface of the toner particles by friction between the toner particles themselves or between the toner particles and a development sleeve or the like. The one-component toner is likewise used in developing a latent electrostatic image.

The charge triboelectrically built up on the surface of the toner particles should be either a positive or a negative charge depending upon the type of a photoelectric conductor used in forming a latent electrostatic image, and the amount of the charge should be sufficient to develop the latent electrostatic image accurately to a visible image. It is the general practice therefore to control the polarity of the electric charge and the amount of the charge on the surface of the toner particles by dispersing a charge controlling agent or an electrically conductive substance in a binder used in the toner particles.

Metal-containing complex salt dyes, for example, have previously been known as charge controlling agents used to apply a negative charge to toner paricles, as is shown in U. S. Pat. No. 3,411,936, for example. Since, however, these negative charge controlling agents are complex in structure and require troublesome production and purification steps, they do not have a constant quality, and suffer from the defect of poor stability and reliability. This raises many problems in quality control as well as in controlling toner production steps. A further disadvantage is that these negative charge controlling agents are susceptible to decomposition and degeneration by thermal and mechanical effects during the melt-kneading and pulverizing steps in the production of toner particles by dispersing them in thermoplastic resins as binders, and consequently tend to decrease in their ability to control charges. As a result, there is a tendency to marked variations in toner characteristics among production lots of the resulting toner characteristics within a single production lot.

Furthermore, since these negative charge controlling agents have poor compatibility with thermoplastic resin binders and are generally colored, toners produced by using them have poor transparency so that when they are dyed in a desired color for use in color copying, they cannot give colored copies having a brilliant clear hue.

These negative charge controlling agents, as is the coloring agent, are present in the form of dispersed particles in the binder. However, since the charge controlling agents have poor compatibility and have no element which can be fixed to the binder, the dispersed particles of the charge controlling agents present on the surface layer of the toner particles may drop off in fluidization and friction within a copying machine at the time of accumulating electric charges on the surface of the toner particles, or in the pulverization step during toner particle production. This leads to the defect that the amount of charge on the toner particles varies or the chargeability of the toner particles varies from particle to particle. This defect increases as the number of copying cycles increases and therefore the time during which the toner particles are subjected to fluidization and friction becomes longer. It is difficult therefore to maintain a stable charged condition over an extended period of time.

It is an object of this invention to solve the aforesaid problems of the negative charge controlling agents, such as their low stability and their poor compatibility with the binder, and to provide a negatively chargeable toner for use in dry electrophotography which has stable chargeability, and in which the negative charge controlling agent can be dispersed as colorless or pale-colored transparent particles in a resinous binder so that the toner can be used also as a color toner.

Thus, according to this invention, there is provided a negatively chargeable toner for use in dry electrophotography, said toner comprising (A) a resinous binder composed of at least one resin selected from copolymers of styrene and/or alphamethylstyrene with alkyl (meth)acrylates, (B) 2 to 10 parts by weight, per 100 parts by weight of the resinous binder, of a copolymer containing a sulfonic acid group, said copolymer having a weight average molecular weight of from 2,000 to 15,000 and composed of 80 to 98% by weight of recurring units represented by the formula

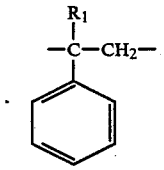

(I)

wherein $R_1$ represents a hydrogen atom or a methyl group, and 20 to 2% by weight of recurring units represented by the formula

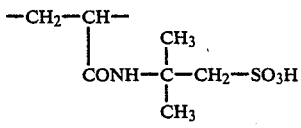

(II)

and (C) a coloring agent.

The negatively chargeable toner of this invention comprises a combination of the resinous binder (A) and the copolymer (B) containing a sulfonic acid group. The copolymer (B) imparts negative charging characteristics having excellent durability and stability to the binder resin (A) and at the same time can be dispersed as transparent or pale-colored transparent particles in the resinous binder (A). Hence, the toner of this invention can also be conveniently applied to color copying.

The term "lower", as used in the present specification and the appended claims to qualify groups or compounds, means that the groups or compounds so qualified have not more than 10, preferably not more than 5, carbon atoms.

The "alkyl group" is a linear, branched or cyclic monovalent aliphatic hydrocarbon group. Examples of the alkyl group include those having 1 to 10 carbon atoms such as methyl, ethyl, n- or iso-propyl, n-, sec-, iso- or tert-butyl, n-, sec-, iso- or tert-amyl, n-, sec-, iso- or tert-hexyl, n-, sec-, iso- or tert-octyl, n-sec-iso- or tert-nonyl, n-, sec-, iso- or tert-decane, cyclohexyl and cyclopentyl. Of these, lower alkyl groups are preferred.

The weight average molecular weight ($\overline{M}w$) and number average molecular weight ($\overline{M}n$) of the polymer or resin are determined by gel permeation chromatography using a sample of the polymer or resin and a polystyrene standard both in tetrahydrofuran.

The negatively chargeable toner of this inven tion will be described in detail below.

(A) Resinous Binder

In the present invention, at least one resin selected from copolymers of styrene and/or alpha-methylstyrene with alkyl (meth)acrylates is used as a resinous binder of the toner. Such copolymers may be selected from known binder resins used heretofore in dry electrophotographic toners.

Examples of the alkyl (meth)acrylates which can be copolymerized with styrene and/or alpha-methylstyrene include methyl (meth)acrylate, ethyl (meth)acrylate, butyl (meth)acrylate, propyl (meth)acrylate, amyl (meth)acrylate, 2-ethylhexyl (meth)acrylate, cyclohexyl (meth)acrylate, lauryl (meth)acrylate and stearyl (meth)acrylate. They may be used singly or in combination. Of these, methyl (meth)acrylate, ethyl (meth)acrylate, propyl (meth)acrylate, ethyl (meth)acrylate, propyl (meth)acrylate, n-butyl (meth)acrylate, and 2-ethylhexyl (meth)acrylate are preferred.

The copolymerization ratio between styrene and/or alpha-methylstyrene and the alkyl (meth)acrylate, as the weight ratio of styrene and/or alpha-methylstyrene to the alkyl (meth)acrylate, is generally from 50:50 to 90:10, preferably from 60:40 to 85:15. The copolymer preferably has a glass transition temperature (Tg) of about 50 to about 80° C., particularly 50 to 70° C. Preferably, the $\overline{M}w/\overline{M}n$ of the copolymer is generally from 2 to 50, particularly from 10 to 40.

The copolymer may optionally contain a small proportion (preferably not more than 3% by weight based on the weight of the polymer) of units of a third monomer. The third monomer may be a compound having 2 or more copolymerizable unsaturated groups per molecule. Examples include alkylene or di- or poly-alkylene glycol di(meth)acrylates such as ethylene glycol di(meth)acrylate, diethylene glycol di(meth)acrylate, polyethylene glycol di(meth)acrylate, propylene glycol di(meth)acrylate and butanediol di(meth)acrylate; poly(meth)acrylates of polyhydric alcohols such as trimethylolpropane tri(meth)acrylate; and divinylbenzene and divinylnaphthalene. The use of these third monomers gives a copolymer partly having a three-dimensional crosslinked structure. It should be understood that the copolymer of styrene and/or alpha-methylstyrene and the alkyl (meth)acrylate includes these partly having a three-dimensional crosslinked structure.

(B) Sulfonic acid group-containing copolymers

As a negative charge controlling agent for imparting good negative charging characteristics to the toner, the present invention uses a specific copolymer containing a sulfonic acid group comprising 80 to 98% by weight of recurring units represented by the following formula

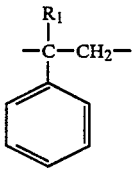

(I)

wherein $R_1$ represents a hydrogen atom or a methyl group, and 20 to 2% by weight of recurring units represented by the formula

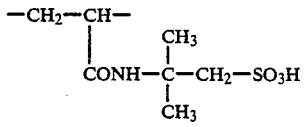

(II)

This copolymer will be sometimes referred to as the copolymer (B) hereinafter.

The units of formula (I) are derived from styrene, alpha-methylstyrene, or a combination of both. These units are important for dispersing the copolymer (B) in the resinous binder while the copolymer retains good transparency. If the proportion of the units (I) exceeds 98% by weight in the copolymer (B), the compatibility of the copolymer (B) with the binder resin is improved. By the amount of the copolymer (B) to be mixed with the resinous binder to obtain negative charging characteristics required of the toner particles must be increased, and the copolymer (B) adversely affects the fixability of the toner image. If the proportion of the units (I) in the copolymer (B) is less than 80% by weight, it is difficult to obtain the desirable amount of charge, and the toner particles tend to have reduced moisture resistance.

The recurring units of formula (I) may account for 80 to 98% by weight, preferably 87 to 95% by weight, more preferably 90 to 95% by weight, of the total weight of the copolymer (B).

Part of the recurring units of formula (I) may be replaced by recurring units derived from an alkyl (meth)-acrylate represented by the following formula

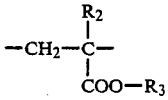

(III)

wherein $R_2$ represents a hydrogen atom or a methyl group, and $R_3$ represents an alkyl group, preferably methyl, ethyl, n- or iso-propyl, n- or iso-butyl, or 2-ethylhexyl.

This can further increase the compatibility of the copolymer (B) with the resin binder. If, however, the proportion of these additional units is too large, the transparency and charging characteristics of the toner tend to be deteriorated. Conveniently, therefore, the proportion of the units (III) is not more than 20% by weight, preferably not more than 15% by weight, more preferably 10 to 5% by weight, based on the weight of the copolymer (B).

The units of formula (II) are derived from a 2-acrylamido-2-methylpropanesulfonic acid known per se. The proportion of the units (II) may be 20 to 2% by weight, preferably 13 to 5% by weight, more preferably 10 to 5% by weight, based on the weight of the copolymer (B).

The copolymer (B) can be produced, for example, by (a) copolymerizing styrene and/or alpha-methylstyrene and the 2-acrylamido-2-methylpropanesulfonic acid and as required as alkyl (meth)acrylate in the presence of a polymerization initiator. Examples of the polymerization initiator that can be used in the copolymerization reaction include peroxide initiators such as lauroyl peroxide, benzoyl peroxide, di-isopropyl peroxydicarbonate and di-myristyl peroxydicarbonate; and azo initiators such as azobisisobutyronitrile, azobisdimethylvaleronitrile, azobis(2,4-dimethyl-4-methoxyvaleronitrile) and 2-phenylazo(2,4-dimethyl-4-methoxyvaleronitrile). Preferably, the polymerization initiator is used normally in an amount of 0.5 to 5% by weight based on the total amount of the monomeric mixture. The polymerization may be carried out by any method such as solution polymerization, suspension polymerization and bulk polymerization. It is particularly preferred however to adopt a solution polymerization method in which the monomeric mixture is copolymerized in an organic solvent such as benzene, toluene, xylene, dioxane, propylene glycol monomethyl ether, ethylene glycol monomethyl ether, ethyl acetate, isopropyl acetate, methyl ethyl ketone, diethyl ketone and methyl isobutyl ketone or a mixture of such an organic solvent with a lower alcohol such as methanol, ethanol, propanol, isopropanol and butanol.

The copolymer (B) so produced should have an $\overline{M}w$ in the range of 2,000 to 15,000. If the $\overline{M}w$ of the copolymer is less than 2,000, its environmental resistance is poor, and its chargeability in a high humidity environment is greatly reduced. Furthermore, offset tends to occur during fixation. On the other hand, if its $\overline{M}w$ exceeds 15,000, the compatability of the copolymer (B) with the binder resin is reduced. Furthermore, since the copolymer (B) cannot be uniformly dispersed in the binder resin, fogging, staining of the photosensitive material and poor fixation occur. The copolymer (B) preferably has an $\overline{M}w$ of 3,000 to 8,000.

The melt viscosity of the copolymer (B), which may affect the kneadability of the copolymer (B) with the resinous binder and the fixability of the resulting toner, is preferably 10,000 to 5,000,000 poises more preferably 50,100 to 2,000,000 poises at 130° C. In the preparation of the toner of this invention, the copolymer (B) is blended in an amount of 2 to 10 parts by weight, preferably 2 to 7 parts by weight, more preferably 2 to 5 parts by weight, per 100 parts by weight of the resin binder. If the amount of the copolymer (B) is less than 2 parts by weight, the required amount of negative charge is difficult to obtain, and the amount of charge varies from particle to particle. Consequently, the fixed image obtained becomes obscure, or staining of the photosensitive material becomes heavy. On the other hand, if it is larger than 10 parts by weight, the copolymer (B) has reduced environmental resistance and compatibility, and such defects as offset and staining of the photosensitive material occur.

(C) Coloring agent

The coloring agent used in the toner of this invention is not particularly restricted, and can be selected from a wide range of coloring agents. Examples include carbon black, nigrosine dye (C. I. No. 50415B), Aniline Blue (C. I. No. 50405), Chalcoil Oil Blue (C. I. No. 14090), Chrome Yellow (C. I. No. 14090), Ultramarine Blue (C. I. No. 77103), Du Pont Oil Red (C. I. No. 26105), Quinoline Yello (C. I. No. 47005), Methylene Blue Chloride (C. I. No. 52015), Phthalocyanine Blue (C. I. No. 74160), Malachite Green Oxalate (C. I. No. 42000), Lamp Black (C. I. No. 77266), Rose Bengale (C. I. No. 45435), and mixtures of these. The coloring agent is blended in a proportion required to form a visible image of a sufficient density. Usually, it is used in an amount of 1 to 20 parts by weight, preferably 2 to 7 parts by weight, per 100 parts by weight of the resinous binder.

(D) Other additives

In addition to the three essential ingredients, i.e. the resinous binder, the copolymer (B) and the coloring agent, the toner of this invention may further contain a property improver for further improving offset resistance and optionally have releasability. Examples are higher fatty acids, higher fatty acid metal salts, natural or synthetic waxes, higher fatty acid esters or partially saponified products thereof, alkylenebis-fatty acid amides, fluorine resins, and silicone resins. The amount of the property improver is generally 1 to 10 parts by weight per 100 parts by weight of the resinous binder.

In order to retain toner flowability and storage stability, the surface of the toner particles may be treated with 1 to 5 parts, per 100 parts by weight of the toner particles, of colloidal silica, hydrophobic silica, etc.

In the case of a one-component toner, a magnetic powder is melt-kneaded with the above resin binder, the copolymer (B) and the coloring agent and optionally other additives. Examples of the magnetic powder used are ferromagnetic metals such as iron, cobalt and nickel, alloys of these metals and compounds containing these elements, such as ferrite and magnetite, and alloys which do not contain ferromagnetic elements but become ferromagnetic by being subjected to a suitable heat treatment, such as Heuslor's alloys containing manganese and copper such as manganese-copper-aluminum and manganese-copper-tin, and chromium dioxide. The magnetic powder is uniformly dispersed in the resinous binder in the form of a fine powder having an average particle diameter of 0.1 to 1 micron. The amount of the magnetic powder added is generally 20 to 70 parts by weight, preferably 40 to 70 parts by weight, per 100 parts by weight of the resinous binder.

Preparation of a toner

The toner of this invention can be prepared by fully mixing the components mentioned in (A) to (D) by a mixer such as a Henschel mixer or a ball mill, melt-kneading the mixture by a hot kneader such as a hot roll, a kneader, or an extruder, cooling and solidifying the mixture, pulverizing the solidified mixture by a pulverizer such as a hammer mill or a jet mill, and classifying the pulverized mixture and recovering toner particles having an average particle diameter of preferably 5 to 20 microns.

Alternatively, the toner of the invention may be prepared by spray-drying an organic solvent solution of the above components dissolved or dispersed therein, or by mixing the monomeric mixture which is to constitute the resinous binder with the remaining components to form an emulsion, and thereafter subjecting the emulsion to copolymerization.

The negatively chargeable electrophotographic toner provided by this invention has excellent electrophotographic properties because it has stable charging characteristics and the amounnt of charge on it varies little with environmental changes.

The toner of this invention shows compatibility in mixing with the binder and the charge controlling agent to create a colorless or pale-colored transparent condition. Moreover, a colored toner of a brilliant hue can be obtained by using the toner of this invention. Since a transparent colored toner can be obtained, it permits an excellent reproducibility of color in copying on a transparent sheet for use in an overhead projector.

The following examples illustrate the present invention more specifically. In these examples, the copolymerization or mixing ratios of the components are by weight.

EXAMPLE 1

Production of a resinous binder (A):

A 10-liter reactor equipped with a stirrer, a condenser and a thermometer was charged with 4000 ml of a 1.5 % by weight aqueous solution of polyvinyl alcohol (saponified to a degree of 90 %), and a mixture of 1200 g of styrene, 800 g of n-butyl methacrylate, 10 g of ethylene glycol dimethacrylate and 60 g of benzoyl peroxide was put in the reactor with stirring. The mixture was maintained at 80 ° C. for 2 hours, then at 90 ° C. for 2 hours, and finally at 120 ° C. for 2 hours. After the reaction, the reaction mixture was cooled, washed, dehydrated and dried to give a resinous binder (A) having an $\overline{M}w$ of 185,000, an $\overline{M}w/\overline{M}n$ of 17.3 and a glass transition temperature of 63 ° C.

Production of a copolymer (B):

A two-liter flask equipped with a stirrer, a condenser, a thermometer and a nitrogen introducing tube was charged with 300 g of methanol, 100 g of toluene, 570 g of styrene, 30 g of 2-acrylamido-2-methylpropanesulfonic acid and 12 g of lauroyl peroxide. While introducing nitrogen into the flask, the mixture was maintained at 65 ° C. for 10 hours with stirring to effect solution polymerization. The reaction mixture was taken out from the flask, dried under reduced pressure, and then pulverized by a jet mill to prepare a copolymer (B) having an $\overline{M}w$ of 3,000.

Production of a toner

One hundred parts of the resinous binder (A), 5 parts of the copolymer (B) and 5 parts of carbon black (Mitsubishi Carbon #100, a product of Mitsubishi Chemical Industry Co., Ltd.) were mixed for 10 minutes by a mixer and melt-kneaded by a laboplasto mill (made by Toyo Seiki Co., Ltd.; set temperature 150 ° C.; the rotating speed 70 rpm). The mixture was then cooled, finely pulverized by a jet mill, and classified by wind to give toner particles having a particle diameter of 5 to 25 microns. The properties of the resulting non-colored toner particles were evaluated by the following methods, and the results are shown in Table 2.

(1) Changeability

The toner particles and a spherical iron oxide powder were mixed at a ratio of 3:97, and the mixture was triboelectrically charged at 20° C. and 65% RH for a fixed period of time (10 minutes, 60 minutes, 180 minutes). The amount of the charge (μC/g) was measured by using a blow off powder charge measuring device made by Toshiba Chemical Co., Ltd.

(2) Ratio of the amount of the residual charge

The toner particles (the amount of charge is designated as $C_0$) which had been triboelectrically charged for 180 minutes in the procedure described in (1) above were left to stand for 14 hours in an atmosphere kept at a temperature of 35° C. and a relative humidity of 85%. The amount of charge (μC/g) of these toner particles was measured as in (1) above (the amount of charge at this time is designated as $C_1$). The ratio of the amount of the remaining charge was calculated in accordance with the following equation.

$$\text{Ratio (\%) of the amount of the residual charge} = \frac{C_1}{C_0} \times 100$$

(3) Electrophotographic properties

A copying test was performed on the toner particles by a commercial copying machine adapted for negatively chargeable toners. Fogging, staining of the photosensitive material and the state of offset were observed visually.

(4) Compatibility

Without adding carbon black, 100 parts of the resinous binder (A) and 5 parts of the polymer (B) were mixed by a mixer, melt-kneaded, and finely pulverized by a jet mill in the same way as in Example 1. The resulting mixed particles were extruded by a melt indexer and molded into a cylindrical shape with a diameter of about 5 mm. The moled article as visually observed from its side surface, and the compatibility of the above components (A) and (B) was evaluated by the transparency of the molded article.

EXAMPLES 2–4 AND COMPARATIVE EXAMPLES 1–8

Styrene and 2-acrylamido-2-methylpropanesulfonic acid were mixed in the proportions indicated in Table 1, and polymerized in the same way as in Example 1 to give various polymers (B). Using the polymers (B), toner particles were produced, and evaluated as described above. The results are shown in Table 2.

EXAMPLE 5

Red toner particles were prepared in the same way as in Example 1 except that 5 parts of Kayaset Red 30 (a product of Nihon Kayaku Co., Ltd.; C. I. No. Disperse Violet 17) was used instead of carbon black (Mitsubishi Carbon #100). The toner particles were evaluated as described hereinabove and the results are shown in Table 2.

TABLE 1

| | Polymer (B) | | | | Toner particles |
|---|---|---|---|---|---|
| Run (***) | Styrene | AMPS (*) | Initiator (**) | $\overline{M}w$ | Ratio of binder (A) to polymer (B) |
| Ex. 2 | 90 | 10 | 1.0 | 8,200 | 100:7 |
| Ex. 3 | 85 | 15 | 3.0 | 3,100 | 100:8 |
| Ex. 4 | 80 | 20 | 4.5 | 2,600 | 100:3 |
| CEx. 1 | 90 | 10 | 9.0 | 1,900 | 100:7 |
| CEx. 2 | 90 | 10 | 0.3 | 16,000 | 100:9 |
| CEX. 3 | 99 | 1 | 3.5 | 5,200 | 100:4 |
| CEx. 4 | 75 | 25 | 2.5 | 4,800 | 100:6 |
| CEx. 5 | 90 | 10 | 2.0 | 4,700 | 100:1 |
| CEx. 6 | 90 | 10 | 2.0 | 4,700 | 100:12 |

TABLE 1-continued

| Run (***) | Polymer (B) Styrene | AMPS (*) | Initiator (**) | $\overline{M}w$ | Toner particles Ratio of binder (A) to polymer (B) |
|---|---|---|---|---|---|
| CEx. 7 | 99 | 1 | 4.0 | 3,900 | 100:12 |
| CEx. 8 | 75 | 25 | 2.5 | 5,200 | 100:2 |

(*)2-acrylamido-2-methylpropanesulfonic acid
(**)lauroyl peroxide
(***)Ex. stands for Example, and CEx., Comparative Example.

TABLE 2

| Run | Amount of charge (μC/g) 10 min. | 60 min. | 180 min. | Ratio of the amount of the residual charge (%) | Electrophotographic properties (*) Fogging | Staining of the photosensitive material | Fixability | Offset | Compatibility (**) |
|---|---|---|---|---|---|---|---|---|---|
| Example | | | | | | | | | |
| 1 | 28.4 | 30.7 | 31.8 | 100 | | | | | |
| 2 | 36.1 | 37.2 | 38.4 | 100 | | | | | |
| 3 | 29.7 | 30.8 | 33.1 | 95 | | | | | |
| 4 | 19.5 | 21.4 | 23.7 | 94 | | | | | Δ |
| 5 | 23.4 | 24.7 | 26.5 | 99 | | | | | |
| Comparative Example | | | | | | | | | |
| 1 | 34.2 | 35.1 | 36.4 | 100 | | | | X | |
| 2 | 35.1 | 36.1 | 36.9 | 99 | Δ | | Δ | | Δ |
| 3 | 8.1 | 9.6 | 10.8 | 100 | Δ | Δ | | | |
| 4 | 15.3 | 16.5 | 17.4 | 65 | | | | | X |
| 5 | 7.7 | 8.9 | 9.4 | 99 | Δ | Δ | | | |
| 6 | 40.3 | 42.2 | 43.7 | 70 | Δ | Δ | | | |
| 7 | 10.3 | 10.9 | 11.7 | 98 | Δ | Δ | | Δ | |
| 8 | 11.2 | 12.4 | 13.3 | 75 | Δ | | | | X |

Notes to Table 2
(*): The electrophotographic properties were rated on the following scales.
Fogging
: No change
Δ: Background staining
Staining of the photosensitive material
: No change
Δ: Toner adhesion occurred
Fixability
: No adhesion to an adhesive tape
Δ: Slight adhesion to an adhesive tape
Offset
: None
Δ: Some
X: Occurred
(**): The compatibility was rated on the following scale.
: Colorless transparent
Δ: Slightly hazy
X: Whitely hazy

What is claimed is:

1. A negatively chargeable toner for use in dry electrophotography, said toner comprising (A) a resinous binder composed of at least one resin selected from copolymers of styrene and/or alpha-methylstyrene with alkyl (meth)acrylates, (B) 2 to 10 parts by weight, per 100 parts by weight of the resinous binder, of a copolymer containing a sulfonic acid group, said copolymer having a weight average molecular weight of from 2,000 to 15,000 and composed of 80 to 98% by weight of recurring units represented by the formula

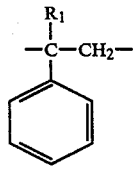

(I)

wherein $R_1$ represents a hydrogen atom or a methyl group, and 20 to 2% by weight of recurring units represented by the formula

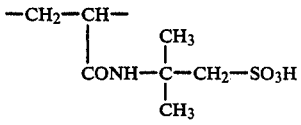

(II)

(C) a coloring agent.

2. The toner of claim 1 wherein the copolymer of styrene and/or alpha-methylstyrene and the alkyl (meth)acrylate has a glass transition temperature of about 50 to about 80° C.

3. The toner of claim 1 wherein the copolymer of styrene and/or alpha-methylstyrene and the alkyl (meth)acrylate has a weight average molecular weight-/number average molecular weight ratio of from 2 to 50.

4. The toner of claim 1 wherein the copolymer of styrene and/or alpha-methylstyrene and the alkyl (meth)acrylate partly has a three-dimensional cross-linked structure.

5. The toner of claim 1 wherein the copolymer containing a sulfonic acid group comprises 87 to 95% by weight of the recurring units of formula (I) and 13 to 5% by weight of the recurring units of formula (II).

6. The toner of claim 1 wherein the copolymer containing a quaternary ammonium salt group further comprises not more than 20% by weight of recurring units derived from an alkyl (meth)acrylate represented by the following formula

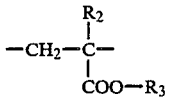

(III)

wherein $R_2$ represents a hydrogen atom or a methyl group, and $R_3$ represents an alkyl group.

7. The toner of claim 1 wherein the copolymer containing a sulfonic acid group has a weight average molecular weight in the range of 3,000 to 8,000.

8. The toner of claim 1 wherein the copolymer containing a sulfonic acid group has a melt viscosity at 130° C. of 10,000 to 5,000,000 poises.

9. The toner of claim 1 wherein the amount of the copolymer containing a sulfonic acid group is 2 to 10 parts by weight per 100 parts by weight of the resinous binder.

10. The toner of claim 1 wherein the amount of the coloring agent is 1 to 20 parts by weight per 100 parts by weight of the resinous binder.

11. The toner of claim 1 which further comprises a property improver.

* * * * *